US006848517B2

(12) United States Patent
Wardley

(10) Patent No.: US 6,848,517 B2
(45) Date of Patent: Feb. 1, 2005

(54) DRILLABLE DRILL BIT NOZZLE

(75) Inventor: Mike Wardley, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/257,662

(22) PCT Filed: Apr. 2, 2001

(86) PCT No.: PCT/GB01/01506

§ 371 (c)(1),
(2), (4) Date: Mar. 5, 2003

(87) PCT Pub. No.: WO01/79650

PCT Pub. Date: Oct. 25, 2001

(65) Prior Publication Data

US 2003/0164250 A1 Sep. 4, 2003

(30) Foreign Application Priority Data

Apr. 13, 2000 (GB) ..... 0008988

(51) Int. Cl.[7] ..... E21B 10/18

(52) U.S. Cl. ..... 175/57; 175/340; 175/393; 175/422

(58) Field of Search ..... 175/340, 393, 175/422, 424, 57; 239/591

(56) References Cited

U.S. PATENT DOCUMENTS

| | | | | |
|---|---|---|---|---|
| 3,111,179 A | | 11/1963 | Albers et al. | 175/393 |
| 3,552,848 A | | 1/1971 | Van Wagner | 355/3 |
| 4,241,878 A | | 12/1980 | Underwood | 239/591 |
| 4,392,534 A | * | 7/1983 | Miida | 175/340 |
| 4,407,378 A | | 10/1983 | Thomas | 175/340 |
| 5,148,875 A | | 9/1992 | Karlsson et al. | |
| 5,494,122 A | | 2/1996 | Larsen et al. | 175/340 |
| 5,845,722 A | | 12/1998 | Makohl et al. | |

FOREIGN PATENT DOCUMENTS

| | | | |
|---|---|---|---|
| EP | 0 790 386 | 8/1997 | E21B/10/52 |
| FR | 2 841 293 | 12/2003 | |
| GB | 2 372 765 | 9/2002 | |
| WO | WO 99/64713 | 12/1999 | E21B/7/20 |
| WO | WO 00/50730 | 8/2000 | |

OTHER PUBLICATIONS

International Search Report dated Jul. 31, 2001, for application serial No. PCT/GB01/01506.
PCT Partial International Search Report, International Application No. PCT/US2004/003164, dated Aug. 17, 2004.

* cited by examiner

*Primary Examiner*—William Neuder
(74) *Attorney, Agent, or Firm*—Moser, Patterson & Sheridan

(57) ABSTRACT

A drill bit nozzle providing a through bore for the passage of drilling fluid through a drill bit. The nozzle is made of a material or materials which can be drilled through by standard well bore drilling equipment. The material(s) are selected to provide a surface to the through bore which has a relatively high resistance to erosion to withstand the abrasive and corrosive impact of jetted drilling fluid. Embodiments are described using a hard chrome/copper combination and a single rubber material.

13 Claims, 1 Drawing Sheet

DRILLABLE DRILL BIT NOZZLE

CROSS-REFERENCE TO RELATED APPLICATIONS

This application claims benefit of International Application No. PCT/GB01/01506, filed Apr. 2, 2001, and published under PCT Article 21(2) in English, and claims priority of Great Britain Application No. 0008988.8, filed on Apr. 13, 2000. The aforementioned applications are herein incorporated by reference in their entirety.

BACKGROUND OF THE INVENTION

1. Field of the Invention

The present invention relates to drill bits and nozzles used in conjunction with drill bits for use in the drilling of oil well bores or other earth drilling applications.

2. Description of the Related Art

Rotary drill bits are well known in the art and typically comprise a drill bit body upon which are mounted cutting elements made of a hard material such as tungsten carbide or diamond. The drill bit bodies are typically provided with nozzle passages for circulating drilling fluid from the interior of the drill bit toward the point where the cutting elements engage the bottom of the bore hole.

Nozzles, both of removable and fixed construction, may optionally be attached to the lower side of a drill bit body and at the end of the nozzle passages for facilitating the jetting of drilling fluid through the passages at the bottom of the hole, thereby providing both a lubrication function in addition to assisting in the carrying away of loose debris and other cut material.

It is recognised in the art that the drilling fluid is very abrasive as it jets through the nozzles and accordingly hard materials have been employed in the past for constructing drill bit nozzles. Such materials have been required to withstand high drilling fluid jet velocities and high pressure differentials across the nozzles.

In our co-pending British Patent Application Number GB9930287.9 there is described a drill bit body which is made substantially of a material that may be drilled through by standard or conventional earth bore drilling equipment. Such technologies may be beneficial when, for example, it is desired to drill with casing and it is desired to leave the drill bit in the bore hole during the cementing of a first section of casing. After the cementing has been complete, a further and smaller diameter drill bit may be employed to extend the well bore and to do this the subsequent drill bit is required to drill through the first drill bit employed.

However, this technology has not been possible until now if the first or earlier drill bit comprised nozzles as nozzles, previously, have required to be made of a hard material for reasons described above that would resist any subsequent attempt to drill through the nozzles.

It is an object therefore of the present invention to provide drill bit nozzles that are constructed to withstand the abrasive and erosive impact of jetted drilling fluid, while also being suitable for subsequent drilling operations intended to drill through drill bit bodies to which the nozzles are attached, and indeed the nozzles themselves.

A further object of the present invention is to provide a method of drilling a well bore, wherein the drilling method is that commonly known as drilling with casing and wherein subsequent drilling may be undertaken by a subsequent drill bit, without the requirement of the removal of the earlier or first drill bit from the well bore, and wherein the earlier or first drill bit includes nozzles.

Other objects and features of this invention will become apparent from time to time throughout the specification and claims as hereinafter related.

SUMMARY OF THE INVENTION

The foregoing objectives are accomplished by a new and improved drill bit nozzle comprising a body defining a through bore, wherein the through bore defines a passage for drilling fluid in use, wherein the surface of the through bore within the body has a relatively high resistance to erosion and wherein the nozzle is characterised in that the body is made substantially of a material or materials that allow for the nozzle to be subsequently drilled through by standard well bore drilling equipment.

Preferably, the through bore has an enlarged concave portion at an inlet side of the nozzle, communicating with a smaller diameter cylindrical portion.

The nozzle body may be made of two materials, wherein the surface of the through bore is made of a first material, wherein said first material is of relatively thin construction and has a high resistance to erosion, and wherein the remainder of the nozzle body is made of a second material that is easily drillable.

The first or surface material may be a hard chrome. Alternatively, tungsten carbide or suitable alloys may be used, their suitability being assessed by their ability to withstand erosive forces from the well fluid jetted through the through-bore.

The second material forming substantially the majority of the nozzle body may be made typically of a softer metal, such as nickel, aluminium, copper or alloys of these.

Preferably, the second material may be copper and the surface or first material is hard chrome, wherein the hard chrome is applied to the copper body by electro-plating.

Alternatively, a nozzle in accordance with the present invention may be made of a rubber material. In this respect, it is noted that while rubber is typically not a "hard" material, it does nevertheless have a high resistance to erosion. Moreover, rubber materials may be easily drilled by subsequent drilling bits.

It may be seen therefore that a nozzle in accordance with invention may be made of one or more materials and that it need not be made entirely or even partially of a metal material. It is also envisaged, for example, that polyurethane or other elastomers may be used.

BRIEF DESCRIPTION OF THE DRAWINGS

An example embodiment of the invention will now be described with reference to the accompanying Figures in which.

DETAILED DESCRIPTION OF THE PREFERRED EMBODIMENT

Figure 1A:
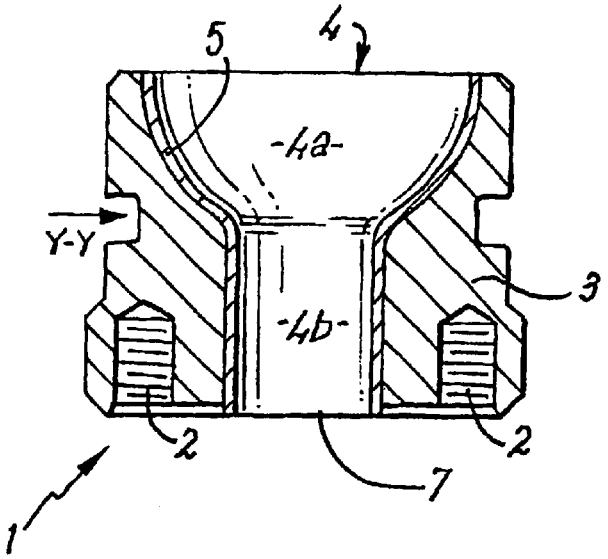
FIG. 1*a*) is a sectional elevation of an earth boring drill bit nozzle.
Figure 1B:
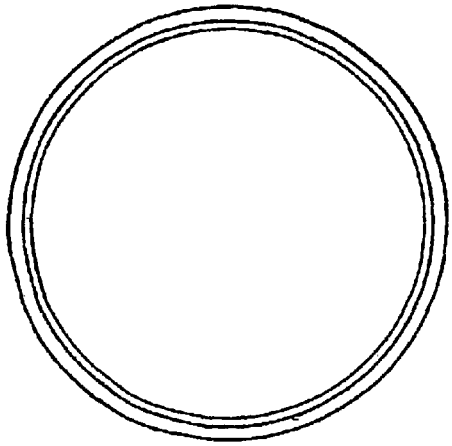
FIG. 1*b*) is a simple sectional view through the section y—y on FIG. 1*a*)

Referring firstly to FIG. 1, there is shown a drill bit nozzle 1. The drill bit nozzle 1 is adapted to be threadably engaged with a drill bit body (not shown) by virtue of the threaded portions 2. The nozzle 1 is provided with an annular body 3 that defines a through passage or through bore 4.

The through bore 4 is formed with an inlet having a concave enlarged portion 4*a* which communicates with a cylindrical smaller diameter portion 4*b* leading to an outlet 7. The geometry of the through-bore 4 is such that well fluid is jetted at high velocity out the outlet 7.

It is recognised in the invention that the nozzle through-bore 4 is intended to receive drilling fluid at high velocities and with high pressure differentials. Accordingly, the surface 5 of the through bore 4 is constructed of a material that is suitable for withstanding the abrasive and eroding nature of the drilling fluid in use. Not only must the surface of the through passage withstand the eroding forces of the drilling fluid, but in view of the proximity of the nozzles to the cutting surface of the drill bit, excessive wear may be induced in the event of a nonresistant material being employed as a result of the impact of small rock particles and other debris cut by the drill bit from the well formation. The erosive effect of rock particles within drill bit nozzles is well known and documented. For this reason, the surface of the through bore 4 is preferably made from a hard material which, in an example embodiment of FIG. 1, is a hard chrome material. In another example, tungsten carbide may be used as the surface material.

However, the surface material will typically be chosen as one which is able to be combined with a softer drillable material whereby this softer drillable material may form substantially the body of the drill bit nozzle, with the exception of the surface herein before mentioned. In the example embodiment illustrated in FIG. 1, the second material from which substantially all of the nozzle body is made is copper. Copper is selected as one suitable material as the surface coating of hard chrome may be easily applied to the copper body by electro-plating means. Additionally, copper is sufficiently soft to allow a subsequent drill bit to drill through the body of the nozzle.

Figure 2:
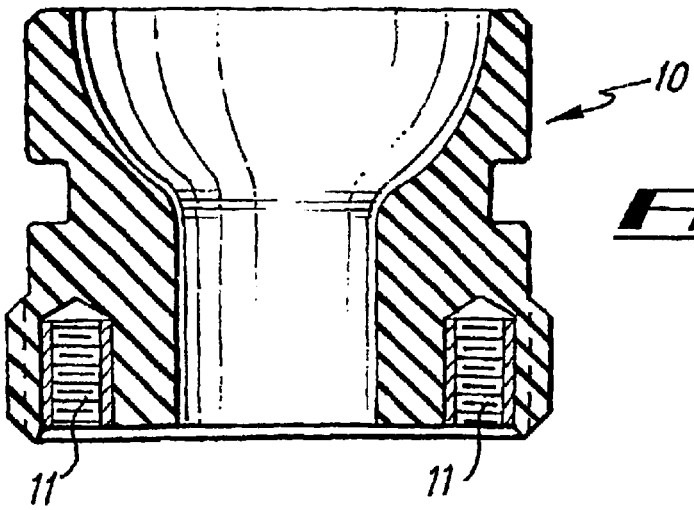
FIG. 2 shows a further drill bit nozzle made substantially of a non-metallic material.

Turning now to FIG. 2, an alternative nozzle in accordance with the present invention is generally depicted at 10. The nozzle 10 is made substantially of a single non-metallic material, namely rubber. However, to enable the rubber nozzle to be attached to a drill bit body, the nozzle is provided with a threaded insert made of a metallic material. The threaded insert 11 is, nevertheless, made of a material which is sufficiently soft to allow a subsequent drill bit to drill through it.

An advantage of the present invention will be apparent from the method of use of the drill bit nozzle as shown in the Figures and described above which allows for a drill bit bearing drill bit nozzles to be left in a well bore during the cementing of casing and subsequently drilled through by standard well bore drilling equipment to allow for the well to be extended.

The invention may be seen to overcome the difficulty of providing drill bit nozzles in a manner that allowed for their resistance to wear from the erosive characteristics of jetted drilling fluid, while nevertheless enabling subsequent conventional or standard well bore drilling equipment to drill through them.

Further modifications and improvements may be incorporated without departing from the scope of the invention herein intended.

What is claimed is:

1. A drill bit nozzle comprising a body defining a through bore, wherein the through bore defines a passage for drilling fluid in use, wherein the through bore includes a surface made from a relatively hard chrome having a relatively high resistance to erosion and wherein the nozzle is characterised in that the body is made substantially of one or more materials that allow for the nozzle to be subsequently drilled through by standard well bore drilling equipment.

2. The drill bit nozzle of claim 1, wherein the through bore includes an enlarged concave portion at an inlet side of the nozzle, communicating with a smaller diameter cylindrical portion.

3. The drill bit nozzle of claim 1, wherein the body is made of two materials, wherein a first material is the hard chrome, said first material being of relatively thin construction, and wherein the body is made of a second material that is easily drillable.

4. The drill bit nozzle of claim 3, wherein the second material is a softer metal comprising nickel or aluminum or copper or alloys of these.

5. A The drill bit nozzle of claim 3, wherein the second material is copper, wherein the hard chrome is applied to the copper body by electro-plating.

6. The drill bit nozzle of claim 1, wherein the nozzle is made substantially by a rubber, polyurethane or other elastomers.

7. A method of drilling a well bore:

(a) drilling a bore to a first depth using a first drill bit having at least one nozzle, the nozzle comprising a body having a bore for fluid communication through the nozzle, wherein a surface of the bore is fabricated from a relatively thin construction of chrome having a relatively high resistance to erosion; and (b) drilling the bore to a second depth using a second drill bit, the second depth being deeper than the first depth and characterised in that the second, drill bit drills through the first drill bit in the bore at the first depth.

8. A drill bit nozzle comprising a body defining a through bore for passage of drilling fluid in use, the through bore includes a surface made from a relatively thin construction of hard chrome having a relatively high resistance to erosion and the body is made of copper that allows the nozzle to be subsequently drilled through by standard well bore drilling equipment, wherein the hard chrome is applied to the copper body by electro-plating.

9. A nozzle for use with a drill bit comprising a body having a bore for fluid communication through the nozzle, wherein a surface of the bore is fabricated from a relatively thin construction of chrome having a relatively high resistance to erosion.

10. The nozzle of claim 9, wherein the hard chrome is applied to the body by electro-plating.

11. A nozzle for use with a drill bit comprising:

a body made substantially from copper, the body having a bore for fluid communication through the nozzle, a surface of the bore is made from a relatively thin material having a relatively high resistance to erosion.

12. The nozzle of claim 11, wherein the thin material is hard chrome.

13. The nozzle of claim 11, wherein the thin material is a tungsten carbide or suitable alloy.

* * * * *